US010821314B2

(12) United States Patent
Ayoub et al.

(10) Patent No.: US 10,821,314 B2
(45) Date of Patent: Nov. 3, 2020

(54) ADJUSTABLE TENSION DEVICE FOR USE WITH A RESISTANCE BAND EXERCISE APPARATUS

(71) Applicants: Victor R Ayoub, Fort Lee, NJ (US); Lawrence C Edelman, East Brunswick, NJ (US)

(72) Inventors: Victor R Ayoub, Fort Lee, NJ (US); Lawrence C Edelman, East Brunswick, NJ (US)

( * ) Notice: Subject to any disclaimer, the term of this patent is extended or adjusted under 35 U.S.C. 154(b) by 0 days.

(21) Appl. No.: 16/312,887

(22) PCT Filed: Jul. 3, 2017

(86) PCT No.: PCT/US2017/040624

§ 371 (c)(1),
(2) Date: Dec. 21, 2018

(87) PCT Pub. No.: WO2018/009489

PCT Pub. Date: Jan. 11, 2018

(65) Prior Publication Data

US 2019/0168054 A1 Jun. 6, 2019

Related U.S. Application Data

(60) Provisional application No. 62/358,004, filed on Jul. 3, 2016.

(51) Int. Cl.

| | |
|---|---|
| ***A63B 21/00*** | (2006.01) |
| ***A63B 21/04*** | (2006.01) |
| ***A44B 1/18*** | (2006.01) |
| ***A44B 13/00*** | (2006.01) |
| ***A63B 21/055*** | (2006.01) |

(Continued)

(52) U.S. Cl.

CPC ..... *A63B 21/00069* (2013.01); *A44B 1/18* (2013.01); *A44B 13/00* (2013.01); *A63B 21/018* (2013.01); *A63B 21/0442* (2013.01); *A63B 21/0552* (2013.01); *A63B 21/0557* (2013.01); *A63B 21/1618* (2013.01); *A63B 21/4035* (2015.10); *A63B 23/1281* (2013.01); *A63B 71/0054* (2013.01); *A63B 21/4043* (2015.10);

(Continued)

(58) Field of Classification Search

CPC ..... A44B 1/18; A44B 13/00; A44B 13/0058; A63B 21/00069; A63B 21/018; A63B 21/0442; A63B 21/0552; A63B 21/0557; A63B 21/1618; A63B 21/4035; A63B 21/4043; A63B 23/03533; A63B 21/1281; A63B 71/0054; A63B 2071/0072; A63B 2071/027

See application file for complete search history.

(56) References Cited

U.S. PATENT DOCUMENTS 3,462,142 A * 8/1969 Sterndale ..... A63B 21/018 482/120
4,027,876 A * 6/1977 Johnston ..... A63B 21/018 482/120

(Continued)

*Primary Examiner* — Joshua Lee
(74) *Attorney, Agent, or Firm* — Lawrence C. Edelman

(57) ABSTRACT

The present invention relates to novel apparatus for adjusting the length of a resistance band portion of an exercise apparatus without disconnecting the band from the apparatus, such as an exercise apparatus having a resistance band slidingly coupled between a parachute-like safety device and a user handle.

9 Claims, 5 Drawing Sheets

(51) Int. Cl.

| | |
|---|---|
| ***A63B 21/16*** | (2006.01) |
| ***A63B 71/00*** | (2006.01) |
| ***A63B 23/12*** | (2006.01) |
| ***A63B 21/018*** | (2006.01) |
| *A63B 71/02* | (2006.01) |
| *A63B 23/035* | (2006.01) |

(52) U.S. Cl.
CPC . *A63B 23/03533* (2013.01); *A63B 2071/0072* (2013.01); *A63B 2071/027* (2013.01)

(56) References Cited

U.S. PATENT DOCUMENTS 4,733,862 A * 3/1988 Miller ..... A63B 21/0552 24/129 R
4,762,318 A * 8/1988 Phillips ..... A63B 21/0004 24/115 L
4,909,232 A * 3/1990 Carella ..... A63B 21/0004 124/35.1
5,062,642 A * 11/1991 Berry ..... A63B 21/0004 473/277
5,125,649 A * 6/1992 Fuller ..... A63B 21/0004 482/106
5,549,532 A * 8/1996 Kropp ..... A63B 21/0552 482/122
5,556,368 A * 9/1996 Akin ..... A63B 21/002 482/121
5,653,665 A * 8/1997 Neeley ..... A63B 21/0552 482/106
5,857,948 A * 1/1999 Barnett ..... A63B 21/0004 482/140
5,894,631 A * 4/1999 Chiu ..... A63B 21/0004 16/110.1
6,151,758 A * 11/2000 Chiu ..... A63B 21/0004 16/442
6,398,698 B1 * 6/2002 Hinds ..... A63B 21/0004 482/124
6,866,617 B2 * 3/2005 Chen ..... A63B 21/0004 482/124
7,147,592 B2 * 12/2006 Hinds ..... A63B 21/0552 482/126
9,186,536 B2 * 11/2015 Strachan ..... A63B 21/0557
10,441,836 B1 * 10/2019 Fairhurst ..... A63B 21/0552
2002/0052270 A1 * 5/2002 Hinds ..... A63B 21/0004 482/126
2002/0137609 A1 * 9/2002 Rosati ..... A63B 21/055 482/126
2008/0214330 A1 * 9/2008 Goebel ..... A63B 21/0004 473/438
2010/0167884 A1 * 7/2010 Kassel ..... A63B 21/00185 482/121
2010/0267529 A1 * 10/2010 Ayoub ..... A63B 21/0552 482/121
2011/0162123 A1 * 7/2011 Ly ..... A43C 7/00 2/85
2012/0028769 A1 * 2/2012 Ayoub ..... A63B 21/0552 482/121

* cited by examiner

ADJUSTABLE TENSION DEVICE FOR USE WITH A RESISTANCE BAND EXERCISE APPARATUS

CROSS-REFERENCE TO RELATED APPLICATIONS

This application claims priority under 35 U.S.C. § (119(e) to U.S. Provisional Patent Application Ser. No. 62/358,004, filed on Jul. 3, 2016, which is hereby incorporated by reference in its entirety.

FIELD OF THE INVENTION

The present invention provides novel methods and apparatus for adjusting the length of a resistance band portion of an exercise apparatus.

BACKGROUND OF THE INVENTION

Current resistance band exercise apparatus generally have a fixed-length resistance band that spans a space between two user parts of the exercise apparatus, such as between two handles that are grasped by the hands of the user, and then the users hands move over a given range of motion, which requires a given amount of effort by the user to stretch the resistance band. Over time the user becomes more fit or desires to exercise another part of their body, thereby necessitating a desire by the user to increase the effort needed to stretch the band over the same range of motion. Thus, current technology provides, according to one technique, a clip mechanism at the user handle which allows the user to add additional resistance bands in parallel, or to disconnect the thin low-resistance resistance band and connect in its place a thicker, higher-resistance resistance band. A serious problem with such techniques is that they require disconnection and re-connection of resistance bands from their attachment to the exercise apparatus. Requiring disconnection and re-connection is extremely dangerous, since if the band is able to be disconnected and re-connected by the user, it can also unexpectedly become disconnected at an inopportune time and thereby cause serious bodily injury to the user or those around the user by the handle or the tube moving at great speed through the air and hitting someone in the face or eye, etc. According to the US Consumer Product Safety Commission, there are 10,000 resistance band injuries every year, and this is totally unacceptable. A way must be found to provide a safer resistance band exercise device.

A new and safe resistance band exercise apparatus particularly well adapted for use for physical fitness and physical therapy, is shown and described in our issued U.S. Pat. No. 8,172,735 (hereinafter referred to as our '735 patent), which is hereby incorporated by reference in its entirety.

As shown and described in our '735 patent, the safe resistance band exercise apparatus includes a center chute portion having at each of its opposed ends a fixed length of resistance band for connecting each of its opposed ends to a user grasped handle portion. FIG. 1 herein, to be described in greater detail later, generally shows such an exercise apparatus having a center chute portion, as well as handle portions formed as "mini-chutes". Although such an exercise band is extremely safe, now way is proved to change the length or strength of the resistance bands.

A need exists for a safe way to adjust the force/effort the user must exert to move the handles over a given range of motion, without requiring the user to disconnect and re-connect resistance bands to and from their attachment to the exercise apparatus

SUMMARY OF THE INVENTION

The present invention meets such a need. Described herein is an adjustable tension device for use to adjust a length of the resistance band that spans a space between two user parts of the exercise apparatus, such as a handle that is grasped by the users hand, and a second part which may be a second handle or user part which is held at a fixed position, such as under the users foot. Adjustment of the length of the resistance band that spans the two parts, changes the amount of effort/force the user must exert when moving the parts over a given range of motion.

In accordance with one embodiment of the invention, the adjustable tension device of the present invention comprises a friction device that releasably engages the resistance band at the point of its connection to the handle or the second part, thereby changing the working length of the resistance band. In a preferred embodiment, the second part is the center chute of an exercise apparatus as shown in our forenoted U.S. Pat. No. 8,172,735 and in FIG. 1 herein. By the user selectively releasing engagement of the friction device upon the resistance band, the adjustable tension device may be selectively repositioned to a new location along a length of the resistance band. Upon the user reaching a desired position along the length of the resistance band, the friction device is re-engaged upon the resistance band, and the repositioned friction device becomes secured, by friction force at the newly desired position along the length of the resistance band. If the length of the resistance band spanning the distance between the center chute and the handles to be grasped by the user is less than the length of the band before it was repositioned, then the user will be required to exert a greater effort/force to have the same range of motion between the center chute and the handle, as compared to the effort required before adjusting the length of the resistance band.

Thus, a user force adjustment is provided that does not require disconnection of the resistance band from the exercise apparatus. As noted above, a force adjustment that requires disconnection of the resistance band from its attachment to the exercise apparatus is extremely dangerous, since if the band is able to be disconnected, it can also unexpectedly become disconnected at an inopportune time and thereby cause serious bodily injury to the user or those around the user.

In accordance with one embodiment of the invention, a handle adapted to be grasped by the user of the exercise apparatus is also engaged with the resistance band by a slideable coupling so that the handle can freely slide along a length of the resistance band up to the current position of the friction device. In accordance with another embodiment of the invention, a center chute portion of the exercise apparatus is also engaged with the resistance band by a slideable coupling so that the center chute portion can freely slide along a length of the resistance band up to the current position of the friction device.

An adjustable end point of the resistance band is formed where the adjustable tension device releasably engages the resistance band, thereby adjusting the position of the handle portion or center chute portion along the length of the resistance band. By adjusting the position of the handle portion or center chute portion along the length of the resistance band, the resistance offered by the band over a give range of motion is changed, increased or decreased, depending up whether the length of the band was decreased or increased, respectively.

In accordance with a further embodiment of the invention, one of the handle or center chute portion of the exercise apparatus integrally includes therewith the friction device, as described in more detail below.

In accordance with an embodiment of the invention, an elastic resistance band exercise device is provided, comprising;

an elastic resistance band having first and second opposed ends, where each of the first and second ends is coupled to a respective one of a first and second user portion so that a user can stretch said elastic resistance band over a range of motion and thereby establish a range of elastic tension between said first and second user portions;

wherein said coupling at at least one of the user portions is via a sliding coupling formed by said resistance band passing through an opening attached to the user portion; and a friction device connected with the at least one user portion for releasably engaging the resistance band at the point of its sliding coupling with the user portion, so as to substantially prevent movement of the resistance band through said opening when engaged.

In accordance with a further embodiment of the invention, the sliding coupling comprises a tab affixed at one of the user portions, which tab has an opening formed therein through which the elastic resistance band passes through.

In accordance with a further embodiment of the invention, the tab is formed by two layers of material, where a grommet is positioned in said tab to form a first opening of said sliding coupling and where a second opening of said sliding coupling is a channel formed by a space bound between the two layers of material, an outer edge of the grommet and an end of the tab.

In accordance with a further embodiment of the invention, the first and second openings cooperate to form the friction device.

These and other aspects of the present invention will be described in greater detail below.

BRIEF DESCRIPTION OF THE DRAWINGS

The accompanying drawings, which are incorporated herein and constitute part of this specification, illustrate embodiments and details of the invention, and, together with the general description given above and the detailed description given below, serve to explain the features of the invention.

DETAILED DESCRIPTION OF THE INVENTION

Various embodiments of the present invention provide a novel device for adjusting the length of a resistance band. The device finds applications in fields such as physical fitness, exercise and therapy apparatus.

While the following text may reference or exemplify specific components of a device or a method of utilizing the device, it is not intended to limit the scope of the invention to such particular references or examples. Various modifications may be made by those skilled in the art, in view of practical and economic considerations, such as the concentration of graphene oxide and the shear rate for forming emulsion.

The articles "a" and "an" as used herein refers to "one or more" or "at least one," unless otherwise indicated. That is, reference to any element or component of the present invention by the indefinite article "a" or "an" does not exclude the possibility that more than one element or component is present.

The term "about" as used herein refers to the referenced numeric indication plus or minus 10% of that referenced numeric indication.

As noted above, FIGS. 1-7D herein illustrate the use of an air-brake safety device at the mid-section of the resistance band of an exercise device, and FIGS. 7E and 7F 7D herein illustrate the use of an air-brake safety device at the opposed ends of the resistance band exercise device, as well as at the mid-section, so as to make a totally safe exercise resistance band device.

Figure 1:
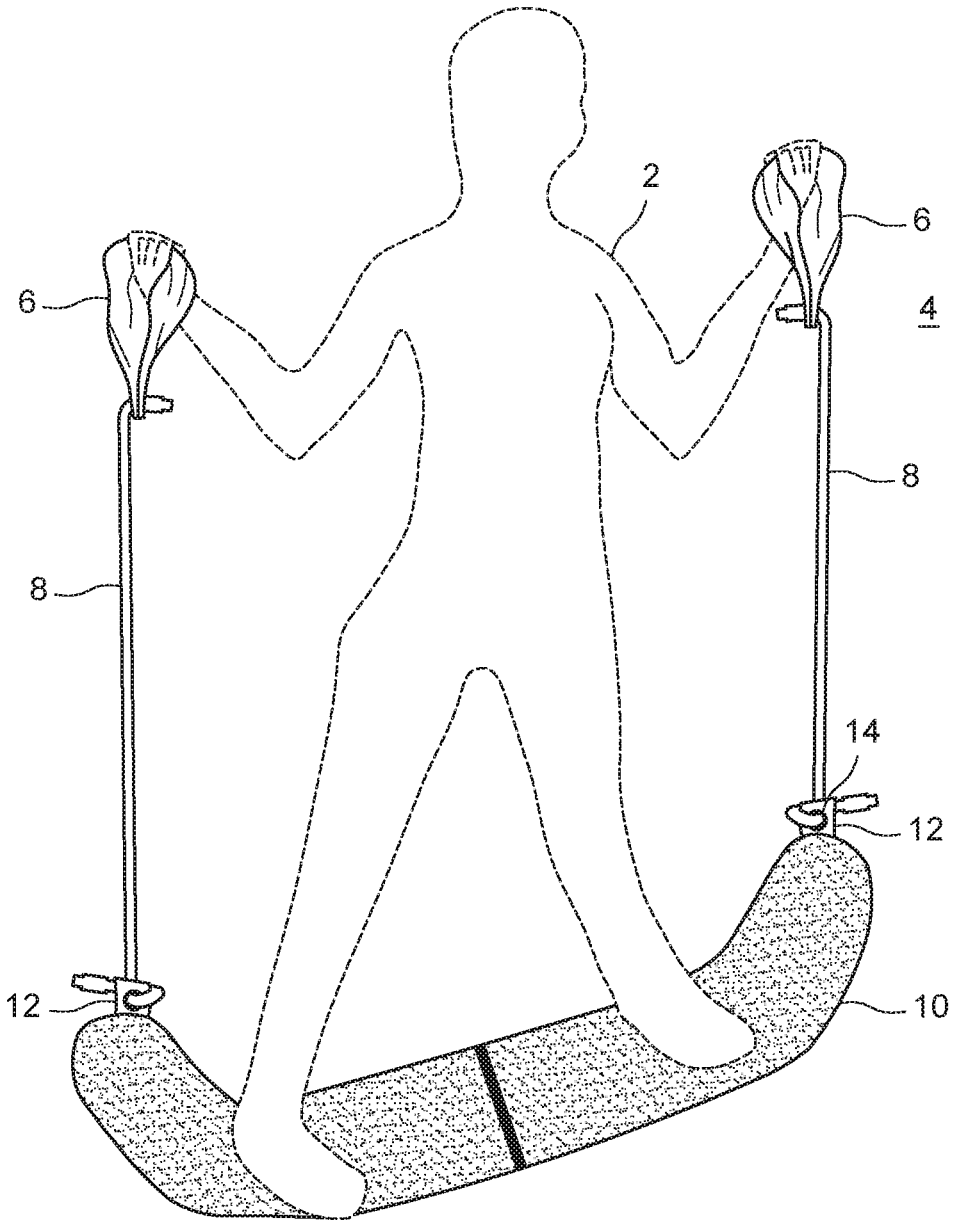
FIG. 1 illustrates a resistance band exercise apparatus in accordance with an embodiment of the invention having a center chute and handle portions as described in our forenoted '735 U.S. patent, having a center chute and mini-chute handles. As described therein, the chute portions greatly reduce the force of any snap-back in the event of unwanted release of the middle portion or handles from a retained position or a users grasp, as compared with if the user had released a hard plastic or metal handle. A preferred embodiment of the friction device is shown at the opposed ends of the center chute of FIG. 1.

FIG. 1 illustrates one embodiment of a resistance band exercise device 4 having the adjustable tension device of the present invention. The resistance band exercise device 4 includes a chute portion 10 in the center (which may be referred to as a safety net, air brake or Parachute-mount section) having opposed ends connected by resistance bands 8 to handles 6 adapted to be grasped by a user 2. It is the chute portion 10 that provides the air resistance which will substantially reduce or eliminate the snap back effect in the event of a mount or placement failure causing an unwanted release of the center portion 10 from a fixed position. This center portion 10 can be made of a netting type of nylon material or may comprise an air impervious material such as used in parachutes, and have a shape of approx 30" in length and 6"-12" in width (plus or minus 25%, as any given design may require) so as to catch the air in the event the band snaps back. The center portion 10 may be gathered at its opposing ends so as to form an overall cupped or parachute type of shape for the center portion of the apparatus 4, and the ends are securely attached to approximately 18" to. 24" inches of elastic band material 8. The handles 6 can be substantially the same shape as the center chute 10 but 50% to 75% smaller, where the opposed ends are brought together by a common tab to which the resistance bands 8 are attached.

Typically, the elastic band material 8 is formed of surgical tubing or other elastic, resistive material, such as "Thera-Bands"®.

Additionally, center chute 10 may include a strip of flexible material sewn or otherwise affixed to its center, which material aids in the mounting of the center chute 10 to a fixed position, such as a door, as more fully described in our '735 patent.

Referring again back to FIG. 1, in that event that during the tension phase of the resistance bands 8 the elastic bands or one the mounting of the center chute 10 to a fixed position were to suffer a sudden release, the cupped or parachute shape of the center chute 10 is designed so that the wind caused by the sudden release would cause the center chute 10 to "billow out" or stated another way, to "deploy" so that the air caught by the center chute 10 would "drag" and greatly slow down the movement of the band 8 and one of the handle 6 or chute 19, thereby greatly reducing or substantially eliminating a snap back of those parts towards the user, thereby resulting in a safer resistance band exercise apparatus.

Construction:

As shown generally in FIG. 1 and in greater detail in FIGS. 2A-2E, center chute 10 has a tab 12 on each end. Each tab 12 has a grommet 14 positioned thereon so as to divide the tab 12 into a lower part 16 to be secured to the chute 10 and an upper part 18 positioned above the grommet 14. Because tab 12 is formed by a strip of web material about 4 inches long folded over on itself, when the two free ends of the web material are sewn together when first and second ones of a tab 12 are sewn onto respective opposite ends of chute 10, each tab 12 basically comprises a loop of web material. Thus, by careful positioning of the grommet 14 in tab 12, one can precisely determine the diameter of a channel 20 which is necessarily formed in upper part 18 upon fixing of the grommet 14 therein.

Alternatively, instead of using the grommet 14 to determine the diameter of channel 20, it may be advantageous in some embodiments to stitch or use some other means to form the channel 20, instead of the grommet, thereby allowing more freedom of where to position the grommet 14, without affecting the diameter of the channel 20.

Figure 2A:
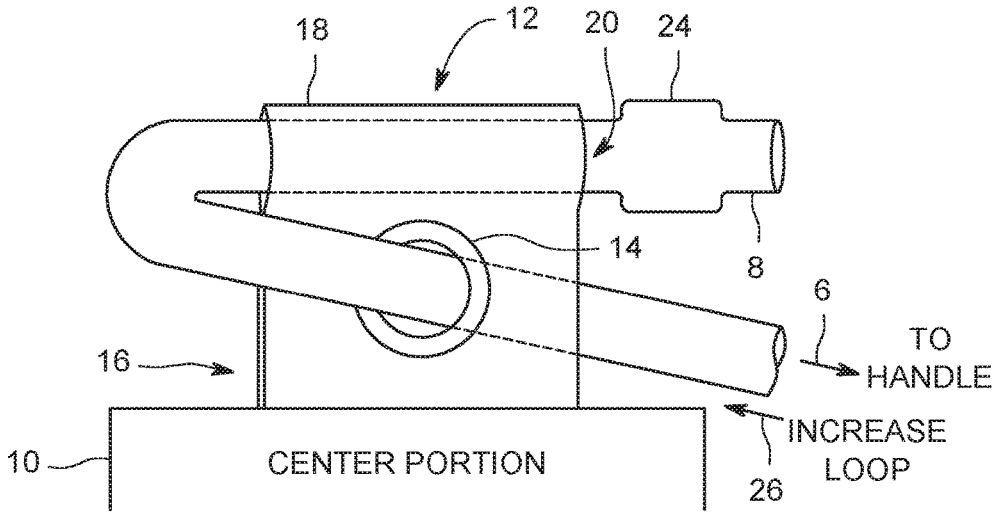
FIGS. 2A, 2B, 2C and 2D illustrate details of the friction device shown in FIG. 1 and how the device can be adjusted by the user.
Figure 2B:
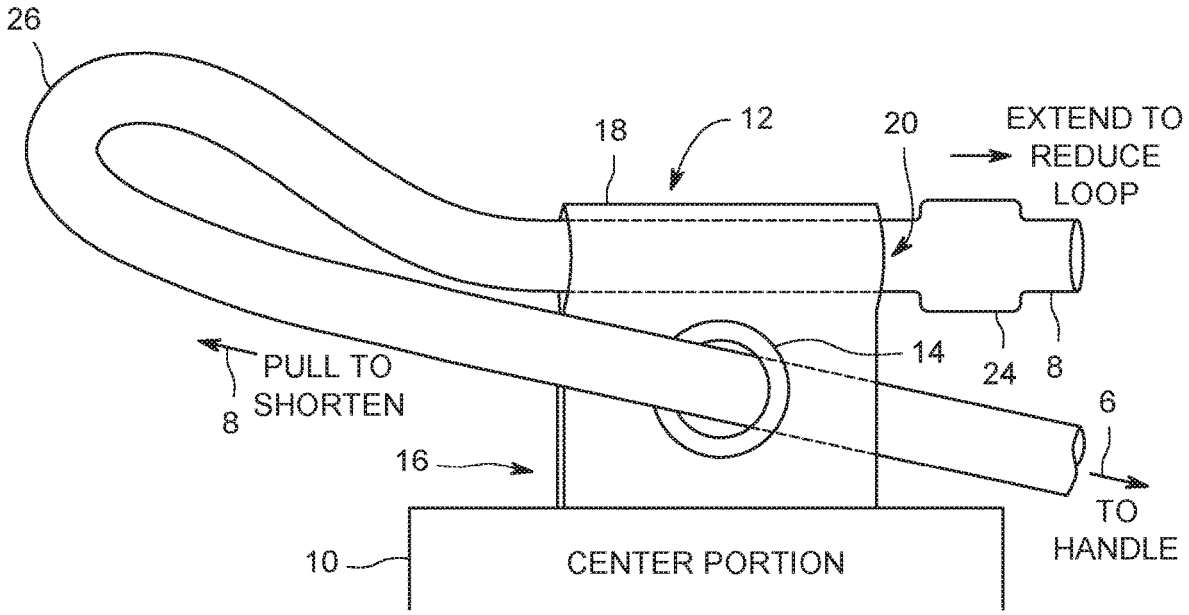
Figure 2C:
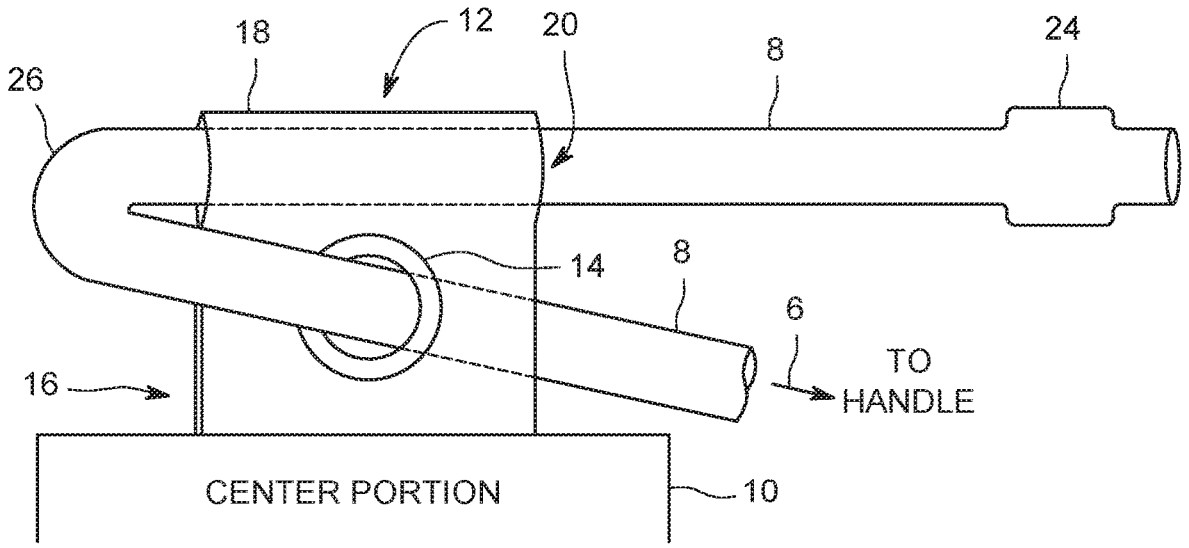
Figure 2D:
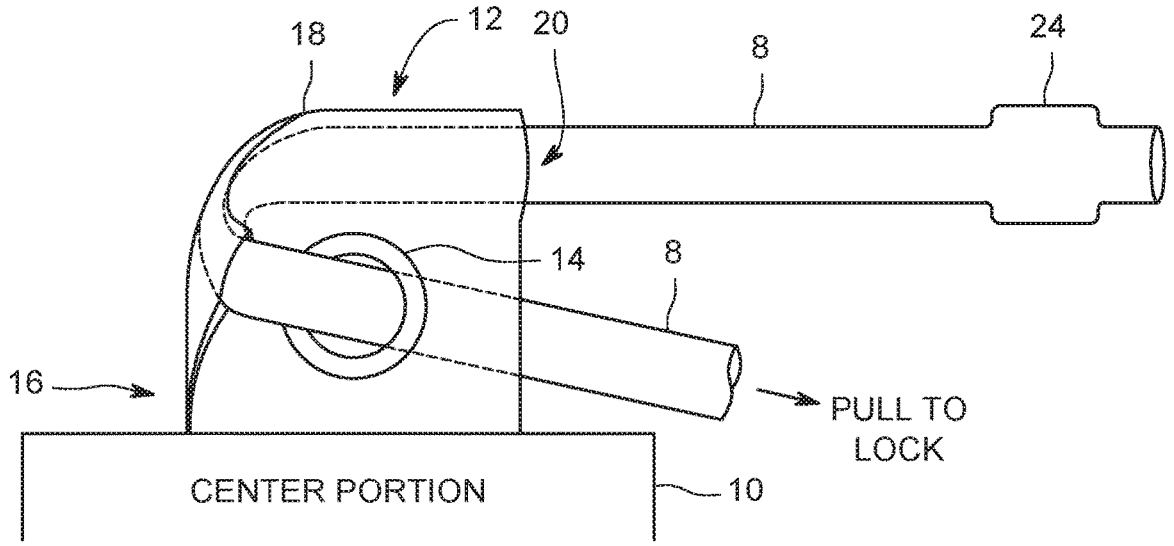
Figure 2E:
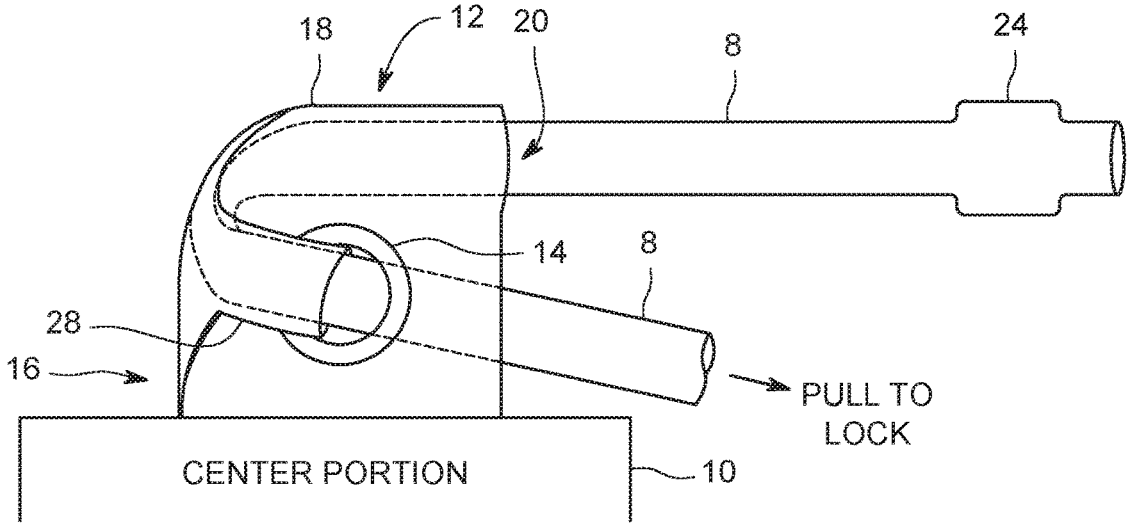
FIG. 2E illustrates an alternative embodiment of the device shown in FIG. 1, where the tab portion which connects the resistance band to the chute has a shoulder portion 28 shaped to extend toward, and preferrably into, the slideable coupling of the resistance band to the chute.

In one embodiment of the invention, shown in FIG. 2E, an outer shoulder portion of part 18 can be formed wider than part 16, so that tab 12 generally comprises an L-shape, where the L portion can serve to protect the band 8 where it passes through a hole in the grommet. Alternatively, parts 16 and 18 can have the same width.

Although in the illustrated embodiment channel 20 is formed in a tab 12 connected to the center chute 10, channel 20 could be formed in a tab connected to the handle portion 6 of the resistance band device 4.

In accordance with the present invention, the hole in the grommet forms a slidable coupling of the resistance band 8 with the center chute 10 (or in an alternative embodiment, handles 6). As will be described in more detail below, the channel 0 forms a friction device which cooperates with the grommet to releasable engage bands 8 at a user adjusted position.

Assembly:

A free end (not shown) of the resistance tube 8 is threaded from the handle (not shown), through grommet 14, and then into a first end of channel 20. At a second end of channel 20, tube 8 is stretched open using a spreader tool and a stopper bead 24 is inserted therein. The diameter of stopper bead 24 is sufficiently greater than the diameter of channel 20 and the hole in grommet 14, so as effectively form a conventional stop which prevents the end of tube 8 having the stopper bead 24 from re-entering channel 20.

In Operation:

Once assembly is complete, the exercise apparatus 4 is provided to a user who can, as noted in our USP '735, stand on the center portion and while grasping the handles 6, move the handles in an up and down motion, thereby getting exercise or physical thereby in a safe way.

If the user desires to adjust the amount of effort to move the handles over a given range of motion, the user merely needs to adjust the friction device which cooperates with the sliding coupling of the band 8 to the center chute 10.

This is accomplished as follows: As shown in FIG. 2A, the user pushes band 8 through the hole in grommet 14 so as to increase the length of a loop 26 of band 8, shown in FIG. 2B. The loop 26 is increased in size until the user has shortened the length of band 8 between the center chute 10 and the handle 6 to a desired length. Thereafter, as shown in FIG. 2C the user pulls on stopper 24 to draw band 8 through channel 20 so as to substantially remove loop 26 from between the channel 20 and grommet 14. Thereafter, when the handle 6 is pulled by the user while using the exercise apparatus, tension in resistance tube 8 causes the left edge of part 18 to fold and be pulled against, and in some cases, into, the opening in grommet 14, thereby causing sufficient friction against the tube 8 to prevent its further passage through grommet 14. Depending upon the diameter of the opening in the grommet, the outer diameter of the tube 8, and the thickness of the web material forming part 18, all or a portion the first end of part 18 may also enter into the opening in grommet 14. As shown in FIG. 2E, a shoulder part 28 of tab 12 may be shaped to further facilitate the extension of the folded portion of part 18 to enter into the hole in grommet 14. In some embodiments this may be particularly beneficial, since the folding of the web material of part 18 will not only assist by adding friction/stopping force to prevent slippage of the tube 8 in grommet 14, but to also protect tube 8 from abrasion that may be caused by rubbing against the inside opening of grommet 14. Although a shaped part 28 for tab portion 18 is not required for the invention, it may be particularly useful for enhancing these benefits. Thus, cooperation of the grommet with the channel in the tab essentially form an adjustable friction device for fixing the resistance band to a user desired position with the sliding coupling.

Accordingly, a tension adjustment for the exercise apparatus 4 is formed by this arrangement, since a user can merely use the technique shown in FIGS. 2A-2D to adjust the resistance tube 8 a desired length between the center chute and the handle, or in an alternative embodiment, between two handles. The shorter the tube, the more tension is presented to the user for a given amount of stretch. Thereafter, when the user applies tension to the tube 8 by pulling the handle, part 18 cooperates with/engages grommet 14 as noted above, thereby causing sufficient friction on tube 8 to prevent its further passage through grommet 14.

Depending upon the coefficient of friction of the materials used to construct the grommet, the web material and the outer surface of the resistance band/tube, the friction can be overcome when sufficient force is applied to the adjustable friction device.

This overcoming of the friction is actually a safety feature in the current environment, since if after the user has adjusted the length of the band, if the user grasping the handle stretches the tubing more than a given amount, such as 250%-400% (depending on the coefficient of friction of the materials), the resistance band will start to slide in the channel, thereby reducing the tension in the band, and helping prevent a sudden snap due to overstretching. Additionally, the reduction in tension caused by slippage of the band in the channel will probably be noticed by the user, who will then realize that they are overstretching the tubing.

Figure 3:
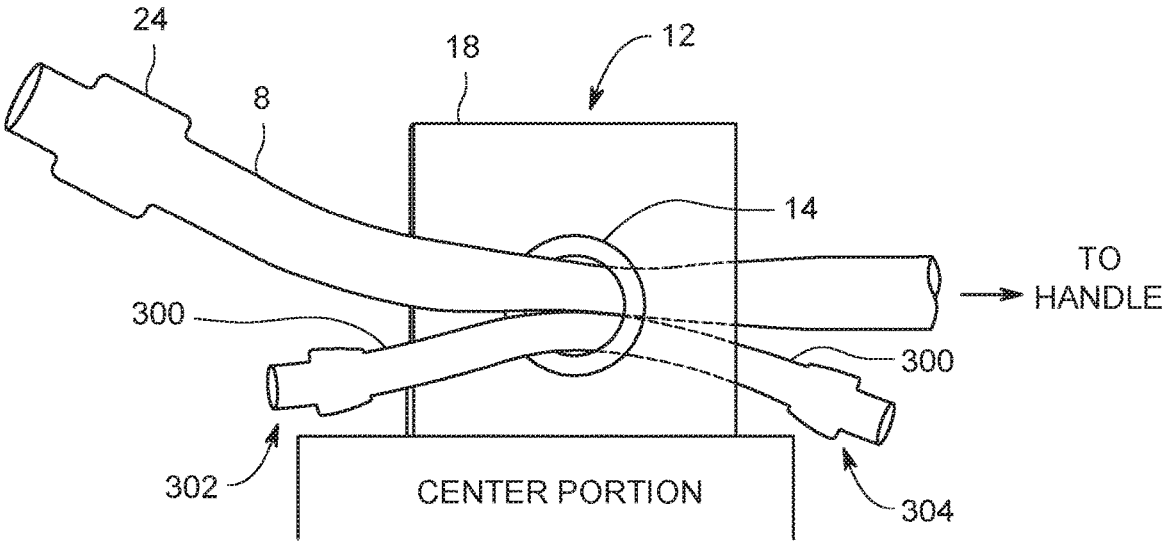
FIGS. 3 and 4 illustrate alternative friction devices that extend through the slideable coupling of the resistance band to the chute, so they can be positioned on a side of the coupling facing away from the handle, and thereby "jam" against the resistance band at the coupling, so as to lock the band at a desired position with respect to the coupling.

FIG. 3 illustrate and alternative embodiment of the invention where instead of the friction device comprising a fold of the tab material, it comprises a further element which cooperates with the opening so as to releasably engage the resistance band at the point where it passes through the opening. More specifically, the further element comprises a length of tubing 300 that passes through the hole in grommet 14 and which has a stopper 302 and 304 at its opposed ends. Once the user slides tube 8 within the hole in grommet 14 to determine a desired length of tube 8 between the center chute 10 and the handle 6, the user merely pulls on tube 300 so as to jam end 302 against tube 8 where tube 8 enters the hole in grommet 14, thereby releasably fixing tube 8 at the desired position. To release tube 8, the user merely pulls on stopper 302 to move it away from grommet 14 and its engagement with tube 8.

Figure 4:
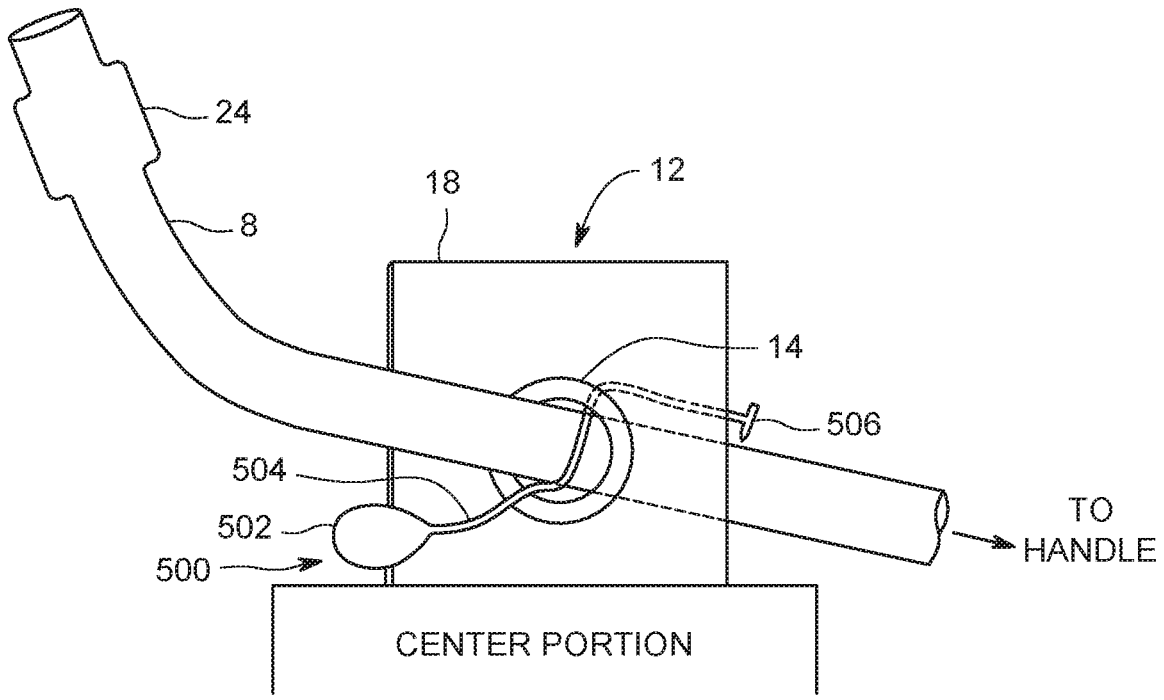

In a similar manner, FIG. 4 shows an alternative embodiment to FIG. 3, in which the further element comprises a length of line 504 that passes through the hole in grommet 14 and which has a wedge-shaped stopper 502 at one end and an attachment tine 506 which is secured to tab 12 by forcing time 506 through a small hole, not shown, in tab 12, so as to secure line 504 to tab 12 in a conventional manner. Once the user slides tube 8 within the hole in grommet 14 to determine a desired length of tube 8 between the center chute 10 and the handle 6, the user merely pulls on line 504 so as to jam wedge 502 against tube 8 where tube 8 enters the hole in grommet 14, thereby releasably fixing tube 8 at the desired position. To release tube 8, the user merely pulls on wedge 502 to move it away from grommet 14 and its engagement with tube 8.

It will be understood by those of skill in the art that numerous and various modifications can be made without departing from the spirit of the present invention. Therefore, it should be understood that the various embodiments of the present invention described herein are illustrative only and not intended to limit the scope of the present invention.

The invention claimed is:

1. An elastic resistance band exercise device, comprising;

an elastic resistance band having first and second opposed ends, where a coupling is provided at each of the first and second ends for coupling said first and second ends to a respective one of first and second user portions so that a user can stretch said elastic resistance band over a range of motion and thereby establish a range of elastic tension between said first and second user portions;

wherein said coupling at at least one of said first and second user portions is a sliding coupling formed by said resistance band passing through a first opening attached to the at least one user portion;

a friction device connected with the sliding coupling for releasably engaging the resistance band at the sliding coupling, so as to substantially prevent movement of the resistance band through said first opening of said sliding coupling when engaged;

where the sliding coupling comprises a tab affixed at one of the user portions, which tab has said first opening formed therein through which the elastic resistance band passes through; and where the tab is formed by two layers of material, where a grommet is positioned in said tab to form said first opening of said sliding coupling and where a second opening of said sliding coupling is a channel formed by a space bound between the two layers of material, an outer edge of the grommet and an end of the tab.

2. The elastic resistance band exercise device of claim 1, where the first and second openings cooperate to form the friction device.

3. The elastic resistance band exercise device of claim 2, where the first and second user portions comprise first and second handles, each handle adapted to be grasped by a user, where a respective one of first and second ones of said sliding coupling is affixed to each handle, and where the elastic resistance band has a first end connected to the first handle via said first opening of said first sliding coupling and a second end connected to the second handle via said first and second openings of said second sliding coupling.

4. The elastic resistance band exercise device of claim 2, where one end of the elastic resistance band includes a stopper to prevent it from passing through the second opening, and the other end of the elastic resistance band threads through the second opening and then through the first opening, so as to form the sliding coupling with the first user portion in a manner that integrally forms the friction device, and then is affixed to the second user portion.

5. The elastic resistance band exercise device of claim 4, where tension in the elastic resistance band causes the channel in the tab to fold towards the first opening, which fold causes an increase of friction against said elastic resistance band within the channel sufficient to substantially fix the position of the elastic resistance band at said sliding coupling, so that a user can stretch said elastic resistance band over a desired range of motion and thereby establish a desired range of elastic tension between said first and second user portions.

6. The elastic resistance band exercise device of claim 4, where the first user portion is a center chute of flexible material and the second user portion is a handle adapted to be grasped by a user, and where the sliding coupling that integrally forms the friction device is formed at each of the opposed ends of the center chute.

7. The elastic resistance band exercise device of claim 5, where a perimeter edge of the tab which forms said channel has an elongate shoulder portion shaped so as partially engage the first opening when the channel folds towards the first opening.

8. The elastic resistance band exercise device of claim 1, where said first user portion comprises a sheet-like material having a substantially elongate shape and opposed ends, and where each of the opposed ends is coupled to a handle as the second user portion, the handles adapted to be grasped by a user of the exercise device and provide tension between the first and second user portions, said sheet-like material of the first user portion functions so as to provide an air brake for a respective end of said resistance band coupled thereto in the event said tension causes said sheet-like material to be suddenly moved.

9. An elastic resistance band exercise device, comprising;

an elastic resistance band having first and second opposed ends, where a coupling is provided at each of the first and second ends for coupling said first and second ends to a respective one of first and second user portions so that a user can stretch said elastic resistance band over a range of motion and thereby establish a range of elastic tension between said first and second user portions;

wherein said coupling at at least one of said first and second user portions is a sliding coupling comprising a tab affixed at one of the user portions, which tab has a first opening formed therein through which the elastic resistance band passes through; and a friction device connected with the sliding coupling for releasably engaging the resistance band at the sliding coupling, so as to substantially prevent movement of the resistance band through said first opening when engaged;

where the tab is formed by two layers of material, where a grommet is positioned in said tab to form said first opening of said sliding coupling and where a second opening of said sliding coupling is a channel formed by a space bound between the two layers of material, an outer edge of the grommet and an end of the tab, such that the first and second openings cooperate to form the friction device.

* * * * *